US011042104B2

(12) United States Patent
Mochizuki et al.

(10) Patent No.: US 11,042,104 B2
(45) Date of Patent: Jun. 22, 2021

(54) IMAGE FORMING APPARATUS THAT SETS PERIPHERAL VELOCITY RATIOS

(71) Applicant: CANON KABUSHIKI KAISHA, Tokyo (JP)

(72) Inventors: Masataka Mochizuki, Mishima (JP); Keitaro Nakata, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/934,644

(22) Filed: Jul. 21, 2020

(65) Prior Publication Data

US 2020/0348612 A1 Nov. 5, 2020

Related U.S. Application Data

(63) Continuation of application No. 16/565,956, filed on Sep. 10, 2019, now Pat. No. 10,754,273.

(30) Foreign Application Priority Data

Sep. 14, 2018 (JP) ..... JP2018-172925
Aug. 2, 2019 (JP) ..... JP2019-143084

(51) Int. Cl.
*G03G 15/00* (2006.01)
*G03G 15/02* (2006.01)
(Continued)

(52) U.S. Cl.
CPC ..... *G03G 15/045* (2013.01); *G03G 15/0266* (2013.01); *G03G 15/50* (2013.01); *G03G 2221/0005* (2013.01)

(58) Field of Classification Search
CPC ..... G03G 15/065; G03G 15/5008; G03G 15/5045; G03G 15/75; G03G 21/20; G03G 21/203
(Continued)

(56) References Cited

U.S. PATENT DOCUMENTS 7,317,889 B2 1/2008 Suzuki
9,946,188 B2 4/2018 Noguchi
(Continued)

FOREIGN PATENT DOCUMENTS

JP 2017173460 A 9/2017

OTHER PUBLICATIONS

Office Action issued in U.S. Appl. No. 16/565,956 dated Feb. 25, 2020.
(Continued)

*Primary Examiner* — William J Royer
(74) *Attorney, Agent, or Firm* — Rossi, Kimms & McDowell LLP

(57) ABSTRACT

An image forming apparatus includes an image bearing member, a developer bearing member, a driving unit, a latent image forming unit that forms an electrostatic image having light area potential and a dark area potential, and an application unit that applies a developing bias. The driving unit drives the image bearing member and the developer bearing member in a first peripheral speed ratio and a second peripheral speed ratio larger than the first peripheral speed ratio. The image forming apparatus further includes an acquiring unit acquiring information related to a change in an electrostatic capacitance of the image bearing member and a determining unit determining a developing contrast according to the electrostatic capacitance. The determining unit determines the developing contrast based on the acquired information when the driving unit drives the image bearing member and the developer bearing member in the second peripheral speed ratio.

10 Claims, 9 Drawing Sheets

(51) Int. Cl.
*G03G 15/045* (2006.01)
*G03G 15/08* (2006.01)

(58) Field of Classification Search
USPC ..... 399/26, 44, 55, 167
See application file for complete search history.

(56) References Cited

U.S. PATENT DOCUMENTS

| | | | | |
|---|---|---|---|---|
| 10,754,273 | B2 * | 8/2020 | Mochizuki et al. ... | G03G 15/50 |
| 2017/0277068 | A1 | 9/2017 | Naito | |

OTHER PUBLICATIONS

Notice of Allowance issued in U.S. Appl. No. 16/565,956 dated Apr. 22, 2020.

* cited by examiner

IMAGE FORMING APPARATUS THAT SETS PERIPHERAL VELOCITY RATIOS

BACKGROUND OF THE INVENTION

Field of the Invention

The present invention relates to an image forming apparatus such as a copying machine, a printer, and a facsimile.

Description of the Related Art

Conventionally, as an image forming apparatus such as a laser beam printer, an in-line color image forming apparatus including a plurality of image forming stations in which a plurality of photosensitive drums as an image bearing member are arranged in a rotation direction of an intermediate transfer member is known. In the image forming apparatus, an electrostatic latent image created on each of the photosensitive drums in the plurality of image forming stations is developed as a developer image by a developing device and is primarily transferred to the intermediate transfer member. This primary transfer process is repeated similarly in the plurality of image forming stations whereby a full-color developer image is formed on the intermediate transfer member. Subsequently, the full-color developer image is secondarily transferred to a recording material, and the full-color developer image is fixed to the recording material by a fixing unit.

In the developing device, a developing roller that blocks an opening of a developer container that mainly stores a developer is provided in a state in which a portion thereof is exposed to the outside. Moreover, in the developing device, a developer supply roller that supplies a developer to a developing roller and a developer regulating blade that abuts on a surface of the developing roller to regulate the amount of a developer conveyed by the developing roller to a certain amount are provided.

When the developer adhering to the surface of the developing roller passes between the developer regulating blade with the rotation of the developing roller, a surplus developer is removed from the surface of the developing roller and is returned to the developer container, and a thin layer of developer is formed on the developing roller. At the same time, triboelectric charge (hereinafter referred to as "tribo-charge") is applied to the developer due to friction against the developer regulating blade, and the tribo-charge moves from a portion of the developing roller exposed from the developer container onto an electrostatic latent image formed on the surface of the photosensitive drum rotating in a state of opposing the developing roller to form a developer image.

A developer which is not used in a developing region and remains on the developing roller is scraped by mechanical friction between the developing roller and the developer supply roller. At the same time, a developer is supplied from the developer supply roller to the developing roller and the developer scraped by the developer supply roller is mixed with a developer inside and around the developer supply roller.

In recent years, in order to obtain an image having a richer density width or tint width as an image created by the image forming apparatus, it is desired to increase the image density and extend tint. In order to attain the object, a technology of increasing the amount of a developer supplied to the photosensitive drum using a mode in which a peripheral velocity ratio of the photosensitive drum to the developing roller is changed as means for realizing a high density and an extended tint in addition to a mode for obtaining an ordinary image density is proposed. Japanese Patent Application Laid-open No. 2017-173460 discloses a method in which, in a configuration in which motors for driving developing rollers are each independently provided so that one motor corresponds to one color, when a peripheral velocity ratio is increased, a developer remains on the developing roller when a developer is developed from the developing roller to the photosensitive drum.

The method disclosed in Japanese Patent Application Laid-open No. 2017-173460 has a mode in which the amount of a developer supplied to the photosensitive drum is increased by increasing the peripheral velocity ratio of the photosensitive drum to the developing roller in order to realize a high density and an extended tint. In this mode, the developer remains on the developing roller when a developer is developed from the developing roller to the photosensitive drum. However, in a site where users actually use an image forming apparatus, it was found that due to a film thickness change of the photosensitive drum, an environmental change, or the like, for example, a difference in tribo-charge of post-no toner and post-black toner increased, and defects such as a developing positive ghost or density unevenness occurred.

Patent Literature 1: Japanese Patent Application Laid-open No. 2017-173460

SUMMARY OF THE INVENTION

The present invention provides an image forming apparatus comprising:

an image bearing member;

a developer bearing member configured to develop an electrostatic image formed on the image bearing member using a developer;

a driving unit configured to drive to rotate the image bearing member and the developer bearing member while individually changing peripheral velocities of the image bearing member and the developer bearing member;

a latent image forming unit configured to form an electrostatic image on the image bearing member by forming a light-part potential and a dark-part potential in the image bearing member; and an application unit configured to apply a developing bias to the developer bearing member, wherein the image forming apparatus is configured to transfer a developer image borne on the image bearing member to a recording material to form an image on the recording material, wherein the driving unit is capable of driving the image bearing member and the developer bearing member in a first peripheral velocity ratio which is a ratio of a peripheral velocity of the developer bearing member to a peripheral velocity of the image bearing member and in a second peripheral velocity ratio that is larger than the first peripheral velocity ratio, wherein an electrostatic capacitance of a portion of the image bearing member is designated as C, the portion is supplied with the developer borne on the developer bearing member, a developing contrast is designated as $\Delta V$, the developing contrast being a potential difference between the light-part potential and the developing bias, a charge amount per unit area of the developer borne on the developer bearing member is designated as Q/S, and the peripheral velocity ratio is designated as $\Delta v$, the peripheral velocity ratio being the ratio of the peripheral velocity of the developer bearing member to the peripheral velocity of the image bearing member, the first peripheral velocity ratio is set so that a relation of $|Q/S \times \Delta v| \leq |C \times \Delta V|$ is satisfied, and the second peripheral velocity ratio is set so that a relation of $|Q/S \times \Delta v| > |C \times \Delta V|$ is satisfied, wherein the image forming apparatus further comprises a first acquiring unit configured to acquire information indicating a change in the electrostatic capacitance and a setting unit configured to set the developing bias according to the electrostatic capacitance, and wherein the setting unit sets the developing bias on the basis of the information acquired by the first acquiring unit when the driving unit drives the image bearing member and the developer bearing member in the second peripheral velocity ratio.

The present invention also provides an image forming apparatus comprising:

an image bearing member;

a developer bearing member configured to develop an electrostatic image formed on the image bearing member using a developer;

a driving unit configured to drive to rotate the developer bearing member;

a latent image forming unit configured to form an electrostatic image on the image bearing member by forming a light-part potential and a dark-part potential in the image bearing member; and an application unit configured to apply a developing bias to the developer bearing member, wherein the image forming apparatus is configured to transfer a developer image borne on the image bearing member to a recording material to form an image on the recording material, wherein the driving unit is capable of driving the developer bearing member in a first peripheral velocity ratio which is a ratio of a peripheral velocity of the developer bearing member to a peripheral velocity of the image bearing member and a second peripheral velocity ratio that is larger than the first peripheral velocity ratio, wherein an electrostatic capacitance of a portion of the image bearing member is designated as C, the portion is supplied with the developer borne on the developer bearing member, a developing contrast is designated as $\Delta V$, the developing contrast being a potential difference between the light-part potential and the developing bias, a charge amount per unit area of the developer borne on the developer bearing member is designated as Q/S, and the peripheral velocity ratio is designated as $\Delta v$, the peripheral velocity ratio being the ratio of the peripheral velocity of the developer bearing member to the peripheral velocity of the image bearing member, the first peripheral velocity ratio is set so that a relation of $|Q/S \times \Delta v| \leq |C \times \Delta V|$ is satisfied, and the second peripheral velocity ratio is set so that a relation of $|Q/S \times \Delta v| > |C \times \Delta V|$ is satisfied, wherein the image forming apparatus further comprises a first acquiring unit configured to acquire information indicating a change in the electrostatic capacitance and a setting unit configured to set the developing bias according to the electrostatic capacitance, wherein the setting unit sets the developing bias on the basis of the information acquired by the first acquiring unit when the driving unit drives the image bearing member and the developer bearing member in the second peripheral velocity ratio, wherein the image forming apparatus comprises a plurality of pairs of the image bearing member and the developer bearing member, and wherein the driving unit drives the developer bearing member included in the plurality of pairs by common control.

A difference in tribo-charge of post-no toner and post-black toner can be suppressed by controlling a developing contrast according to a film thickness change of the image bearing member or an environmental change in the apparatus when an image is formed while increasing a peripheral velocity ratio of the image bearing member to the developer bearing member as compared to a normal peripheral velocity ratio so that a residual toner to which charge is applied after developing is formed on the developing roller after developing.

Further features of the present invention will become apparent from the following description of exemplary embodiments with reference to the attached drawings.

DESCRIPTION OF THE EMBODIMENTS

Hereinafter, modes for carrying out the present invention will be described in detail on the basis of exemplary embodiments with reference to the drawings. Dimensions, materials, shapes, relative arrangements, and the like of components disclosed in the embodiment are to be changed appropriately depending on various conditions and a configuration of an apparatus to which the present invention is applied. That is, the scope of the present invention is not limited to the following embodiments.

Embodiment 1

An image forming apparatus of the present embodiment has two image forming modes including an image forming mode A for obtaining a normal image density and an image forming mode B for changing a peripheral velocity ratio of a photosensitive drum as an image bearing member to a developing roller as a developer bearing member to obtain a high density and an extended selection range of tint. In the respective image forming modes, particularly, under conditions for forming a solid-black image, the rotation velocity ratios (peripheral velocity ratios) of the photosensitive drum to the developing roller are different. In the image forming mode A, an entire toner on the developing roller is developed on the photosensitive drum by a developing contrast formed by a potential of an electrostatic latent image formed on the photosensitive drum and a developing bias applied to the developing roller. In the image forming mode B, the peripheral velocity ratio of the photosensitive drum to the developing roller is increased and the amount of toner supplied from the photosensitive drum to the developing roller is increased. An electrical gradient generated due to the developing contrast is reduced or cancelled by the charge of a charged toner on the developing roller whereby a portion of the toner on the developing roller remains on the developing roller without being moved to the photosensitive drum.

Image Forming Apparatus

Figure 1:
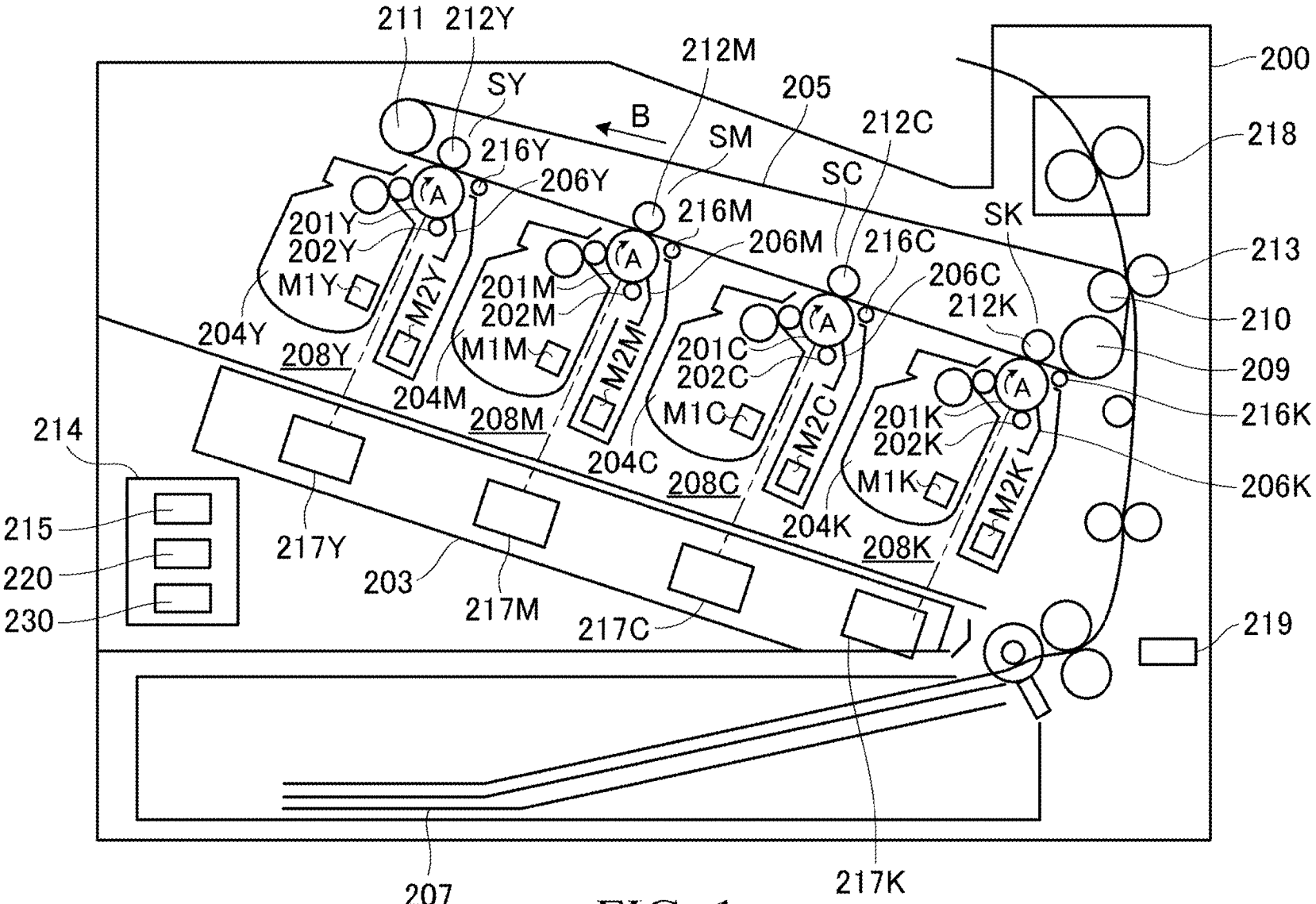
FIG. 1 is a schematic diagram of an image forming apparatus according to Embodiment 1.

An image forming apparatus according to the embodiment will be described using an electrophotographic system as an example with reference to FIG. 1. FIG. 1 is a schematic cross-sectional view of an image forming apparatus 200 according to the present embodiment. The image forming apparatus 200 of the present embodiment is a full-color laser printer which employs an in-line system and an intermediate transfer system. The image forming apparatus 200 can form a full-color image on a recording material (for example, a recording sheet, a plastic sheet, a fabric, or the like) according to image information. The image information is input from a host device (not illustrated) such as an image reading device connected to the image forming apparatus 200 or a personal computer communicably connected to the image forming apparatus 200 to a CPU 215 provided in an engine controller 214. Moreover, control targets of the image forming apparatus 200 are connected to an input/output interface (I/F) 230 of the engine controller 214. The CPU 215 inputs and outputs information to control targets via the input/output I/F 230. Moreover, the CPU 215 deploys and executes various programs stored in a memory 220 to execute various operations to be described later.

The image forming apparatus 200 has first, second, third, and fourth image forming stations SY, SM, SC, and SK for forming images of the respective colors of yellow (Y), magenta (M), cyan (C), and black (K), respectively, as a plurality of image forming units. Here, the image forming station includes a process cartridge 208 and a primary transfer roller 212 disposed on an opposing side with an intermediate transfer belt 205 disposed therebetween. In the present embodiment, the first to fourth image forming units SY, SM, SC, and SK are disposed in a line in a direction crossing a vertical direction. In the present embodiment, the configurations and the operations of the first to fourth image forming units are substantially the same except that the colors of images formed are different. Therefore, when a particular distinction is not required, the subscripts Y, M, C, and K added to the reference numerals to indicate the color of the corresponding component will be omitted, and the image forming units will be described collectively. A black process cartridge which is frequently used may have a larger size than the other process cartridges.

The process cartridge 208 is detachably attached to an image forming apparatus body (hereinafter referred to as an apparatus body) via a fixing unit such as a mounting guide and a positioning member provided in the apparatus body. Here, the apparatus body is an apparatus component part excluding at least the process cartridge 208 from the components of the image forming apparatus 200. A developing unit 204 to be described later may solely be detachably attached to the apparatus body. In this case, an apparatus component part excluding the developing unit 204 from the components of the image forming apparatus 200 may be referred to as the apparatus body.

The image forming apparatus 200 includes four drum-type electrophotographic photosensitive members (that is, photosensitive drums) 201 arranged in parallel in a direction crossing a vertical direction as a plurality of image bearing members. The photosensitive drum 201 is driven and rotated by a motor driving unit as a driving unit (a driving source) in the direction indicated by arrow A (clockwise direction). A charging roller 202 is a charging unit that uniformly charges the surface of the photosensitive drum 201. A scanner unit (an exposure device) 203 is an exposure unit that radiates a laser on the basis of image information to form an electrostatic image (an electrostatic latent image) on the photosensitive drum 201 and includes a number of lasers 217 corresponding to the number of photosensitive drums 201. The developing unit (a developing device) 204 is a developing unit that develops an electrostatic image as a toner image. A cleaning blade 206 is a cleaning unit that removes toner (transfer residual toner) remaining on the surface of the photosensitive drum 201 after transfer and a pre-exposure LED 216 neutralizes the potential on the photosensitive drum 201. The intermediate transfer belt 205 functions as an intermediate transfer member disposed to oppose the four photosensitive drums 201 to transfer the toner image on the photosensitive drum 201 to a recording material 207. The process cartridge 208 includes the photosensitive drum 201 and the charging roller 202 as a charge process unit of the photosensitive drum 201, the developing unit 204, and the cleaning blade 206, which are integrated with each other. The process cartridge 208 is detachably attached to the image forming apparatus 200. Moreover, the developing unit 204 has a memory M1 and a photosensitive member unit 301 has a memory M2. Information related to a driving amount of the developing unit 204 is stored in the memory M1, and information related to a driving amount of the photosensitive drum 201 is stored in the photosensitive member unit 301.

In the present embodiment, the process cartridges 208 of the respective colors have the same shape, and toner components of the respective colors of yellow (Y), magenta (M), cyan (C), and black (K) are stored in the process cartridges 208 of the respective colors. Moreover, the toner used in the present embodiment is toner having negative charging characteristics (a normal charging polarity is minus).

The intermediate transfer belt 205 formed of an endless belt as an intermediate transfer member abuts on all photosensitive drums 201 as an image bearing member and rotates in the direction indicated by arrow B (counter-clockwise direction). The intermediate transfer belt 205 is stretched between a driving roller 209, a secondary transfer opposing roller 210, and a driven roller 211 as a plurality of supporting members. Four primary transfer rollers 212 as a primary transfer unit are arranged in parallel on an inner circumferential side of the intermediate transfer belt 205 so as to oppose the photosensitive drums 201. A bias of a polarity opposite to the normal charging polarity (in the present embodiment, a negative polarity as described above) of toner is applied from a primary transfer bias source (not illustrated) to the primary transfer roller 212. In this way, the toner image on the photosensitive drum 201 is transferred to the intermediate transfer belt 205. Moreover, a secondary transfer roller 213 as a secondary transfer unit is disposed at a position opposing the secondary transfer opposing roller 210 on an outer circumferential side of the intermediate transfer belt 205. A bias of a polarity opposite to the normal charging polarity of the toner is applied from a secondary transfer bias source (not illustrated) to the secondary transfer roller 213. In this way, the toner image on the intermediate transfer belt 205 is transferred to the recording material 207.

The recording material 207 to which a toner image is transferred is conveyed to a fixing device 218 as a fixing unit. In the fixing device 218, heat and pressure are applied to the recording material 207 whereby a toner image is fixed to the recording material 207. After that, the recording material 207 to which the toner image is fixed is discharged to a discharge tray provided on an upper surface of the apparatus body.

Moreover, the image forming apparatus 200 includes a sensor 219 as a detecting unit that detects a moisture content [g/m$^3$] in an ambient environment such as a temperature and a humidity in the image forming apparatus 200 by detecting a temperature and a relative humidity. The sensor 219 is an example of a first acquiring unit that acquires information indicating a change in electrostatic capacitance. The CPU 215 determines whether the ambient environment in the image forming apparatus 200 corresponds to a low-temperature and low-humidity environment, a normal-temperature and normal-humidity environment, or a high-temperature and high-humidity environment on the basis of the moisture content detected by the sensor 219. The image forming apparatus 200 determines a developing contrast according to the determined environments. A specific process of the image forming apparatus 200 will be described later.

Process Cartridge

Figure 2:
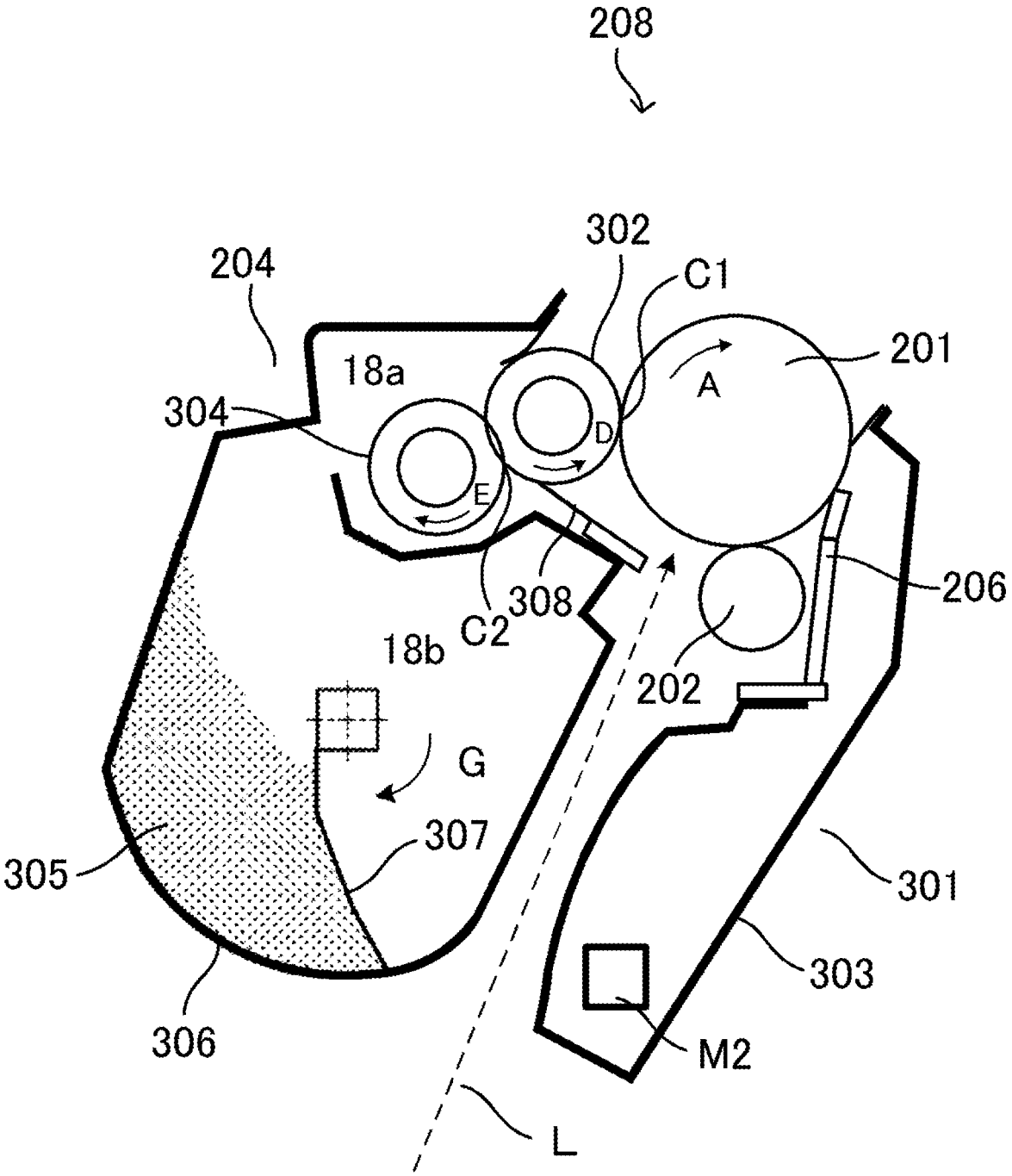
FIG. 2 is a schematic diagram of a process cartridge according to Embodiment 1.

The process cartridge 208 attached to the image forming apparatus 200 of the present embodiment will be described with reference to FIG. 2. FIG. 2 is a cross-sectional view (a main cross-sectional view) schematically illustrating a cross-section vertical to a longitudinal direction (a rotation axis direction) of the photosensitive drum 201 as an image bearing member. In the present embodiment, the configurations and the operations of the process cartridges 208 of the respective colors are substantially the same except for the type (color) of the developer stored therein.

The process cartridge 208 has the photosensitive member unit 301 including the photosensitive drum 201 as an image bearing member and the like and the developing unit 204 including the developing roller 302 and the like. The photosensitive member unit 301 has a cleaning frame body 303 as a frame body that supports various elements of the photosensitive member unit 301. The photosensitive drum 201 is rotatably attached to the cleaning frame body 303 with bearings (not illustrated) disposed therebetween. The photosensitive drum 201 is driven and rotated in the direction indicated by arrow A (clockwise direction) according to an image forming operation when a driving force of a motor driving unit as a driving unit (driving source) is transmitted to the photosensitive member unit 301. The photosensitive drum 201 which plays a major role of an image forming process uses an organic photosensitive member in which an undercoat layer which is a functional film, a carrier generation layer, and a carrier transport layer are coated in that order on an outer circumferential surface of an aluminum cylinder. Moreover, the cleaning blade 206 and the charging roller 202 are disposed in the photosensitive member unit 301 so as to make contact with the circumferential surface of the photosensitive drum 201. The transfer residual toner removed from the photosensitive drum 201 by the cleaning blade 206 falls and is stored in the cleaning frame body 303.

The charging roller 202 which is a charging unit rotates following the photosensitive drum 201 as the image bearing member when a conductive rubber roller portion makes pressure-contact with the photosensitive drum 201. Here, in the core of the charging roller 202, as a charging process, a predetermined DC voltage as a charging bias is applied from a charging voltage application unit (a high-voltage source) as a charging roller bias application unit to the photosensitive drum 201. In this way, a uniform dark-part potential (Vd) is formed on the surface of the photosensitive drum 201. The scanner unit 203 emits a laser beam L corresponding to image data to expose the photosensitive drum 201. The charge on the exposed photosensitive drum 201 disappears due to a carrier from the carrier generation layer whereby the potential thereof decreases. As a result, an electrostatic latent image in which an exposure region has a predetermined light-part potential (Vl) and a non-exposure region has a predetermined dark-part potential (Vd) is formed on the photosensitive drum 201. In the electrostatic latent image, a region in which a light-part potential is formed is a region to which toner adheres, and a region in which a dark-part potential is formed is a region to which toner does not adhere.

The developing unit 204 includes a container frame body 306 having a developing chamber 18*a* and a developer storage chamber 18*b*, and the developer storage chamber 18*b* is disposed below the developing chamber 18*a* to communicate with the developing chamber 18*a* through a communication opening formed in an upper portion of the developer storage chamber 18*b*. Toner 305 as a developer is stored in the developer storage chamber 18*b*. A stirring member (a developer conveying member) 307 for conveying the toner 305 to the developing chamber 18*a* is provided in the developer storage chamber 18*b*. The stirring member 307 conveys the toner 305 by rotating in the direction indicated by arrow G. The stirring member 307 rotates in response to a rotation driving force from a motor driving unit as a driving unit. In the present embodiment, as described above, toner of which the normal charging polarity is negative is used as the toner, and in the following description, it is assumed that negative charge toner is used. However, the toner usable in the present invention is not limited to negative charge toner, but toner of which the normal charging polarity is positive may be used depending on an apparatus configuration.

The developing roller 302 as a developer bearing member that makes contact with the photosensitive drum 201 as an image bearing member and rotates in the direction indicated by arrow D in response to a driving force of the motor driving unit as a driving unit is provided in the developing chamber 18*a*. In the present embodiment, the developing roller 302 and the photosensitive drum 201 rotate so that the surfaces thereof move in the same direction in an opposing portion (a contacting portion C1) which is a portion in which the toner 305 borne by the developing roller 302 is supplied to the photosensitive drum 201. Moreover, the surface of the photosensitive drum 201 is uniformly charged by the charging roller 202. A predetermined charging voltage is applied from a charging voltage application unit 422 as a charging bias application unit to the charging roller 202. Moreover, a predetermined DC bias (a developing bias) sufficient for developing and visualizing the electrostatic latent image on the photosensitive drum 201 as a toner image (a developer image) is applied from a developing voltage application unit (a high-voltage source) 412 (FIG. 3) as a developing bias application unit to the developing roller 302. In the contacting portion C1 in which the developing roller 302 and the photosensitive drum 201 abut on each other, toner is transferred to a light-part potential portion only due to the potential difference to develop the electrostatic latent image.

A toner supply roller (hereinafter referred to as a supply roller) 304 and a developing blade 308 as a toner amount regulating member are disposed in the developing chamber 18*a*. The supply roller 304 as a developer supplying member is a roller for supplying the toner 305 conveyed from the developer storage chamber 18*b* to the developing roller 302. The developing blade 308 regulates a coating amount of the toner on the developing roller 302 supplied by the supply roller 304 and applies charge to the toner. A bias (a supply bias) is applied from a high-voltage source (not illustrated) as a supply bias application unit to the supply roller 304.

Here, the bias applied by a developing voltage application unit (a high-voltage source), a charging voltage application unit (a high-voltage source), and a supply roller bias source is controlled by the CPU 215 which is a control unit on the basis of information obtained by a print mode information acquiring unit. The print mode information acquiring unit acquires the information input from an operation panel or a printer driver (not illustrated) of the image forming apparatus 200.

The supply roller 304 is an elastic sponge roller having a foam layer formed on the periphery of a conductive core and is arranged to form a predetermined contacting portion C2 on the circumferential surface of the developing roller 302 in a portion opposing the developing roller 302. The supply roller 304 rotates in the direction indicated by arrow E in response to a driving force of the motor driving unit as a driving unit.

Figure 3:
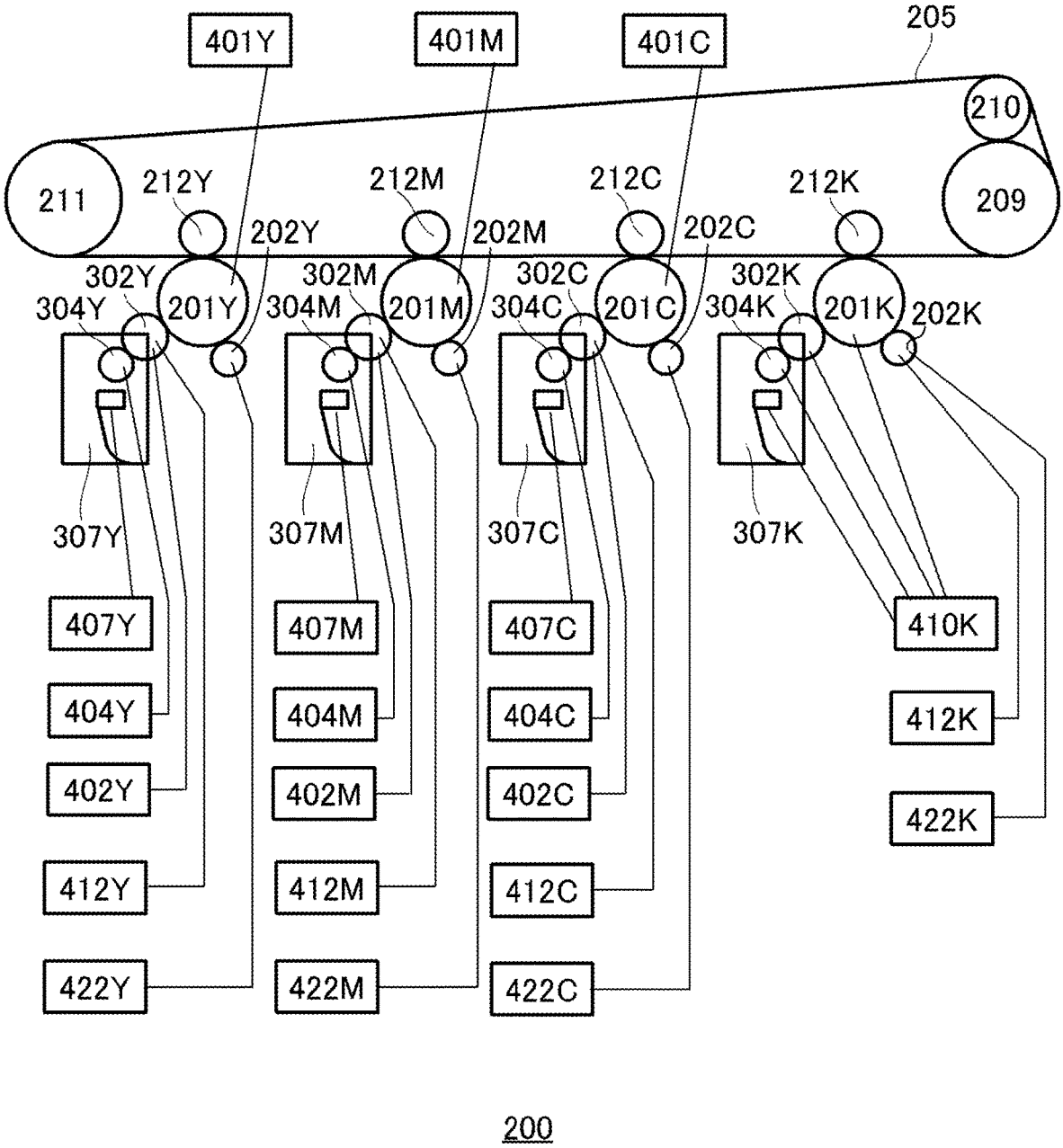
FIG. 3 is a schematic diagram illustrating a portion of the image forming apparatus according to Embodiment 1.

FIG. 3 is a schematic cross-sectional view illustrating an image forming station which is a portion of the image forming apparatus 200 according to the present embodiment. In the present embodiment, the respective portions of the first, second, third, and fourth image forming stations SY, SM, SC, and SK for forming images of the respective colors of yellow (Y), magenta (M), cyan (C), and black (K) are driven by independent motor driving units. Specifically, motor driving units 401Y, 401M, and 401C drive photosensitive drums 201Y, 201M, and 201C of the colors of yellow (Y), magenta (M), and cyan (C), respectively. Moreover, motor driving units 402Y, 402M, and 402C drive developing rollers 302Y, 302M, and 302C of the colors of yellow (Y), magenta (M), and cyan (C), respectively. Moreover, motor driving units 404Y, 404M, and 404C drive toner supply rollers 304Y, 304M, and 304C, respectively. Moreover, motor driving units 407Y, 407M, and 407C drive stirring members 307Y, 307M, and 307C, respectively. Furthermore, a motor driving unit 410K drives a photosensitive drum 201K, a developing roller 302K, a toner supply roller 304K, and a stirring member 307K of the color of black (K). Each of the motor driving units 401, 402, 404, 407, and 410 that drive the photosensitive drum 201, the developing roller 302, the supply roller 304, and the stirring member 307 includes a motor, a gear train that transmits a rotation driving force of the motor, and the like. These motor driving units correspond to a driving unit capable of rotation driving of an image bearing member, a developer bearing member, a supplying member, and a conveying member individually and variably and are controlled by the CPU 215.

As described above, each of the process cartridges of the colors of yellow (Y), magenta (M), and cyan (C) includes a driving unit that drives to rotate a photosensitive drum, a driving unit that drives to rotate a developing roller, a driving unit that drives to rotate a supply roller, and a driving unit that drives to rotate a stirring member. These driving units have independent driving sources. Moreover, the process cartridge 208K of the color of black (K) includes a driving unit that drives to rotate a photosensitive drum, a driving unit that drives to rotate a developing roller, a driving unit that drives to rotate a supply roller, and a driving unit that drives to rotate a stirring member, which are configured as one common driving motor.

Figure 4:
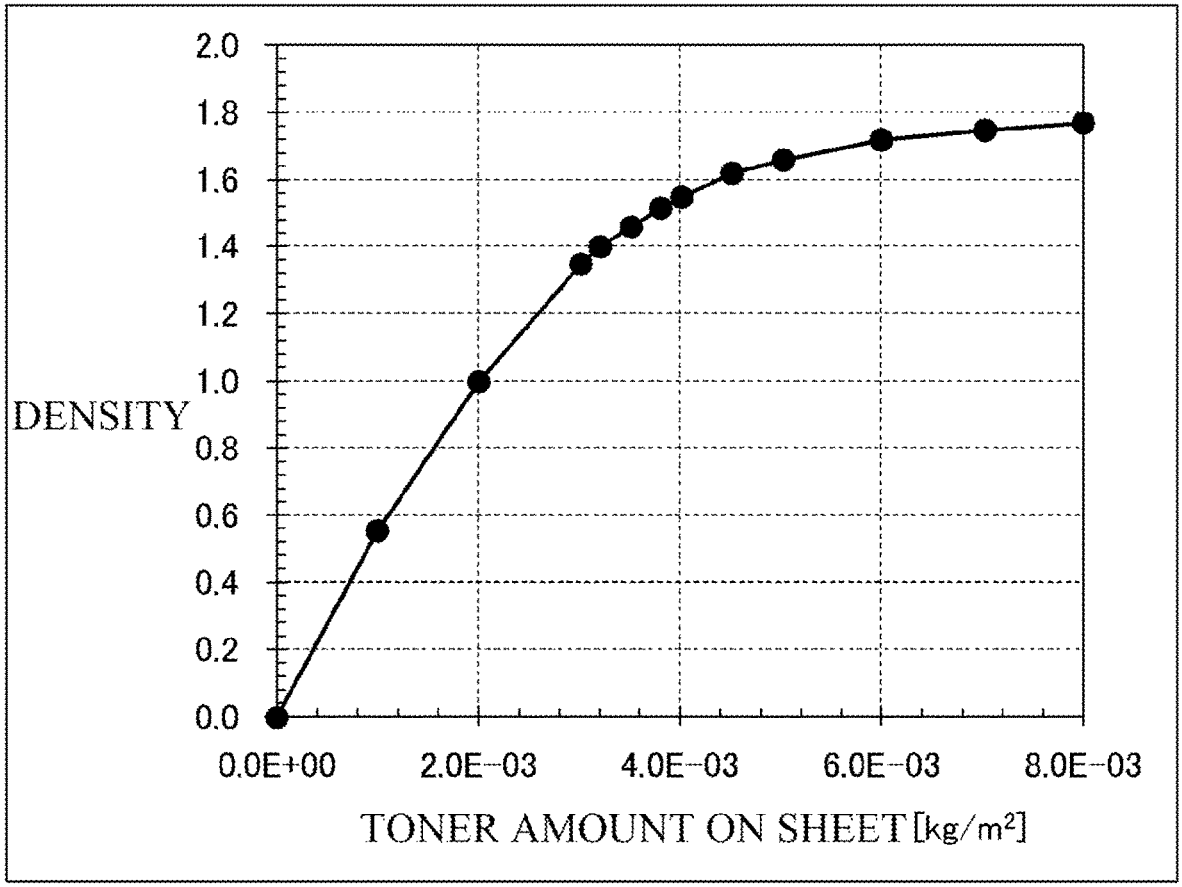
FIG. 4 is an explanatory diagram of a toner amount and a toner density on a sheet according to Embodiment 1.

FIG. 4 is a characteristic diagram illustrating a relation between an image forming density and a supply amount [kg/m$^2$] of the toner 305 from the developing roller 302 as a developer bearing member to the photosensitive drum 201 as an image bearing member, in which a horizontal axis indicates a toner amount on a sheet (a recording material) and a vertical axis indicates a density after fixing. In the above-described configuration, when an image forming operation is performed, the amount of developed toner may vary due to a potential fluctuation of various biases. Image defects such as density unevenness or tint unevenness may occur in an image formed when the toner amount varies. FIG. 4 illustrates an example thereof. The characteristic diagram illustrated in FIG. 4 is obtained using a reflection densitometer (Macbeth RD-918, product of Macbeth Corporation) as a reflection densitometer. As criteria for determining an image density, 1.3 or more is required as an average density of a solid black image as an output image of a high-quality image forming apparatus, for example.

In FIG. 4, when the toner amount is 0 to approximately 1.2, a change in density after fixing becomes steep, which suggests the possibility of a density unevenness due to a variation in the toner amount. As a method of avoiding a density unevenness, it may be effective to develop an electrostatic image on the photosensitive drum using the entire toner coated on the developing roller formed relatively stably. Therefore, as the development setting when developing a high-print-ratio image pattern like a solid-black image, setting of increasing an absolute value (a developing contrast) of a potential difference between a light-part potential and a developing bias applied to the developing roller with respect to a charge amount of toner on the developing roller is employed. A latent image having a sufficient developing contrast is formed so that a stable toner-image-developing image can be obtained even when developing properties fluctuate due to a potential variation or the like. Components associated with forming of a developing contrast according to the present embodiment, that is, the charging roller 202, the charging voltage application unit, the scanner unit 203, the developing roller 302, the developing voltage application unit, and the like correspond to a latent image forming unit.

When the photosensitive drum 201 and the developing roller 302 are operated while increasing the peripheral velocity ratio thereof in order to obtain a higher density and extend a color gamut, if a high-density image is output continuously, a density unevenness or a tint unevenness may occur since toner is not supplied at an appropriate timing. As a developing mechanism, even when images are output continuously in a so-called high-density mode where a large amount of toner is used, although toner is supplied to the vicinity of the developing roller 302, since there is a little chance to apply charge to the supplied toner, the electrification charge of the toner is weak. Due to the weak electrification charge amount, the supply including adhesion of toner to the developing roller 302 is likely to become unstable. Due to the unstable supply, the amount of toner coated on the developing roller 302 or an electrification charge amount of the toner becomes unstable. As a result, a density unevenness or a tint unevenness occurs in an image.

In contrast, under high-density-mode solid-black print conditions, the electrification charge amount per unit area of toner supplied from the developing roller 302 increases, and the developing contrast is controlled so that toner remains on the developing roller 302 after developing or the remaining toner amount increases. In this way, a density unevenness or a tint unevenness is suppressed.

Here, in a high density mode of the present embodiment, a phenomenon (hereinafter referred to as a "development ghost") in which a halftone density of the background color and a halftone density immediately after solid-black printing are different depending on a printing pattern during image forming will be described with reference to FIG. 5. Solid-black printing means an image forming operation with a density of 100% (highest density). A development ghost occurs due to a difference between an electrification charge amount of toner (hereinafter referred to as "post-black toner") on the developing roller 302 in a printing portion and an electrification charge amount of toner (hereinafter referred to as a "post-no toner") on the developing roller 302 in a node parameter NP as illustrated in case "A" in FIG. 5. The difference between the electrification charge amount of the post-no toner and the electrification charge amount of the post-black toner results from a difference in the number of mechanical frictional rubbing times of the respective toner components.

An electrification charge amount due to frictional rubbing in an abutting portion between the developing roller 302 and the developing blade 308 with respect to a developing residual toner which has been triboelectrically charged in advance is added to the post-no toner on the developing roller 302. On the other hand, the post-black toner on the developing roller 302 has an electrification charge amount resulting from one instance of frictional rubbing in an abutting portion between the developing roller 302 and the developing blade 308. Due to a difference in the number of frictional rubbing times, the electrification charge amount of the post-no toner is likely to be larger than the electrification charge amount of the post-black toner.

In a configuration in which the rotation directions of the developing roller 302 and the toner supply roller 304 are the same, a mechanical property of the toner supply roller 304 scraping toner on the developing roller 302 is poor as compared to a configuration in which the rotation directions are opposite. Due to this, the post-no toner is likely to remain on the developing roller 302, and the difference between the electrification charge amount of the post-no toner and the electrification charge amount of the post-black toner may increase.

Figure 5:
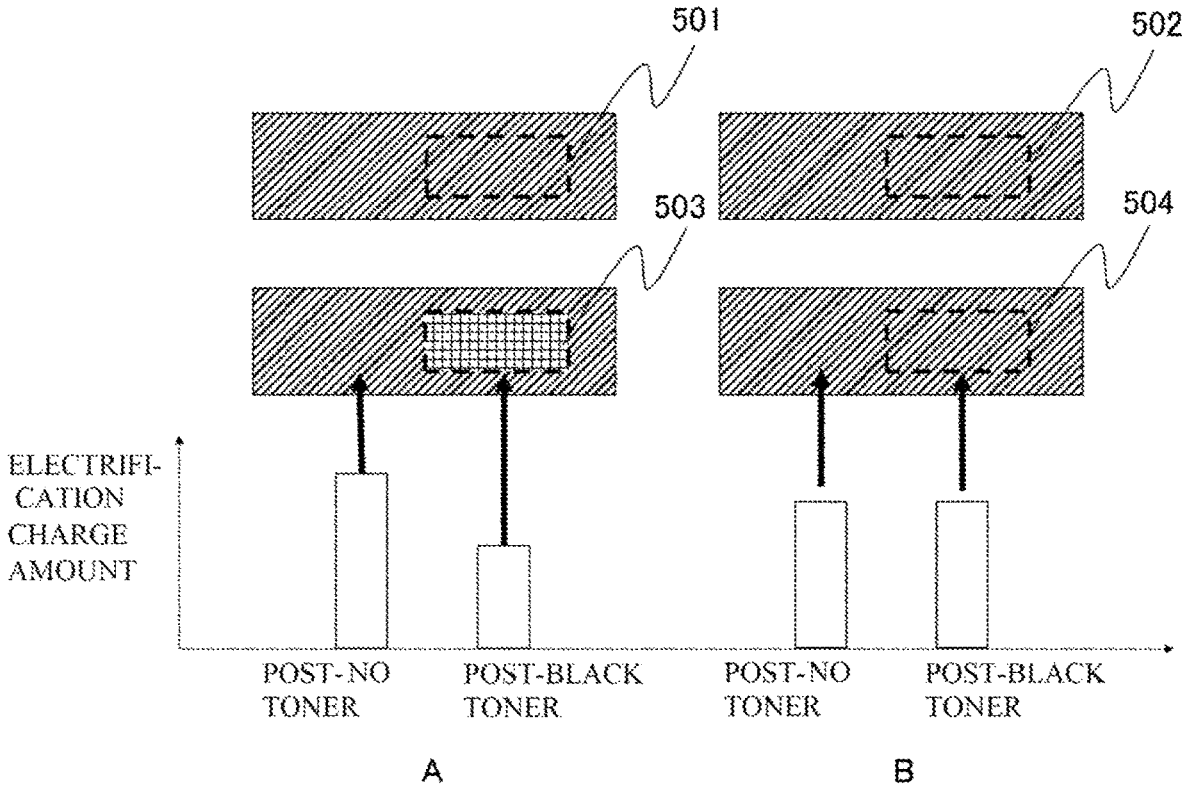
FIG. 5 is an explanatory diagram of development according to Embodiment 1.

In the case "A" in FIG. 5, electrification of the toner (the post-black toner) supplied from the supply roller 304 to the developing roller 302 is delayed in a portion 501 corresponding to a printing portion on the developing roller 302 in solid-black printing. As a result, when toner is supplied to the portion 501 corresponding to a printing portion, an electrification charge amount of the post-black toner immediately after solid-black printing becomes smaller than an electrification charge amount of the post-no toner (see portion 503 in the drawing). Due to this, the amount of toner moving from the portion 503 corresponding to the printing portion to the photosensitive drum 201 on which an electrostatic latent image is formed becomes larger than the toner amount in the post-no toner portion around the corresponding portion 503 whereby a development ghost occurs.

In order to alleviate such a development ghost, as illustrated in case "B" in FIG. 5, an electrification charge amount of the toner supplied to the portion 502 corresponding to a printing portion on the developing roller 302 in solid-black printing is increased by generating a developing residual toner. In this way, the electrification charge amounts of the post-no toner and the post-black toner approach each other (see portion 504 in the drawing). As a result, the amount of toner moving from the portion 504 corresponding to the printing portion to the photosensitive drum 201 becomes approximately the same as the amount of toner moving from the portion of the surrounding post-no toner to the photosensitive drum 201, and the development ghost is alleviated.

In the high-density mode, when the film thickness of the photosensitive drum 201 decreases in the end of the life of the photosensitive drum 201, the electrification charge amount of the toner that can be developed on the photosensitive drum 201 increases. It was found that, as a result, a residual toner on the developing roller 302 after developing decreased or disappeared, a difference in the electrification charge amount of the post-no toner, and the post-black toner increased, and the development ghost worsened.

Therefore, in the present embodiment, the following operation is performed in an apparatus configuration having a normal mode (an image forming mode A) such as office use and a high-density mode (an image forming mode B) for extending tint as an image forming operation mode. In the normal mode as a first operation mode, a setting condition having such a developing contrast that a remaining toner amount after developing disappears substantially for an electrification charge amount per unit area of toner supplied from a developing roller under solid-black density print conditions is used. In the high-density mode as a second operation mode, a toner supply amount is increased by increasing a peripheral velocity ratio of the photosensitive drum to the developing roller under the same condition. In the present embodiment, in the high-density mode for suppressing a density unevenness or a tint unevenness, a developing contrast is controlled according to an electrostatic capacitance of the photosensitive drum 201 so that toner remains on the developing roller 302 after developing. In this way, a density unevenness or a tint unevenness is suppressed while increasing the density and extending the tint.

First, the electrification charge amounts of an electrostatic latent image and a toner formed on the photosensitive drum were examined. In the present embodiment, a dark-part potential after charging was set to −500 V and a light-part potential after laser exposure was set to −100 V. In the present embodiment, the value of the light-part potential is a value obtained by a surface potentiometer measuring the potential on the photosensitive drum when such an image pattern that an entire sheet is developed with toner like a solid-black image was formed. A developing potential (a developing bias) applied to the developing roller was set to −300 V and a developing contrast ΔV at that time was set to 200 V. As for the toner formed on the developing roller, in the present embodiment, a loading amount (hereinafter M/S) of toner per unit area was set to $3.0\times10^{-3}$ kg/m$^2$ and an electrification charge amount (hereinafter Q/S) of toner per unit area was set to $-0.15\times10^{-3}$ C/m$^2$.

Subsequently, the supply amount of toner to the developing contrast was examined. As an examination method, the peripheral velocity of the photosensitive drum was set to 0.2 m/s and the peripheral velocity of the developing roller was changed so that the peripheral velocity ratio which is the ratio of the peripheral velocity of the photosensitive drum to the peripheral velocity of the developing roller was changed. In this case, when a peripheral velocity ratio of 100% is set as a constant velocity, a peripheral velocity ratio of 140% means that the developing roller rotates faster than the photosensitive drum. The peripheral velocity of the developing roller may be fixed to be constant at 0.2 m/s and the peripheral velocity of the photosensitive drum may be decreased so as to increase the peripheral velocity ratio. Since tint and density are closely related, in the description of the present embodiment, description will be made using the density. The toner used in this examination was black toner. The examination results are illustrated in FIGS. 6A and 6B.

Figure 6A:
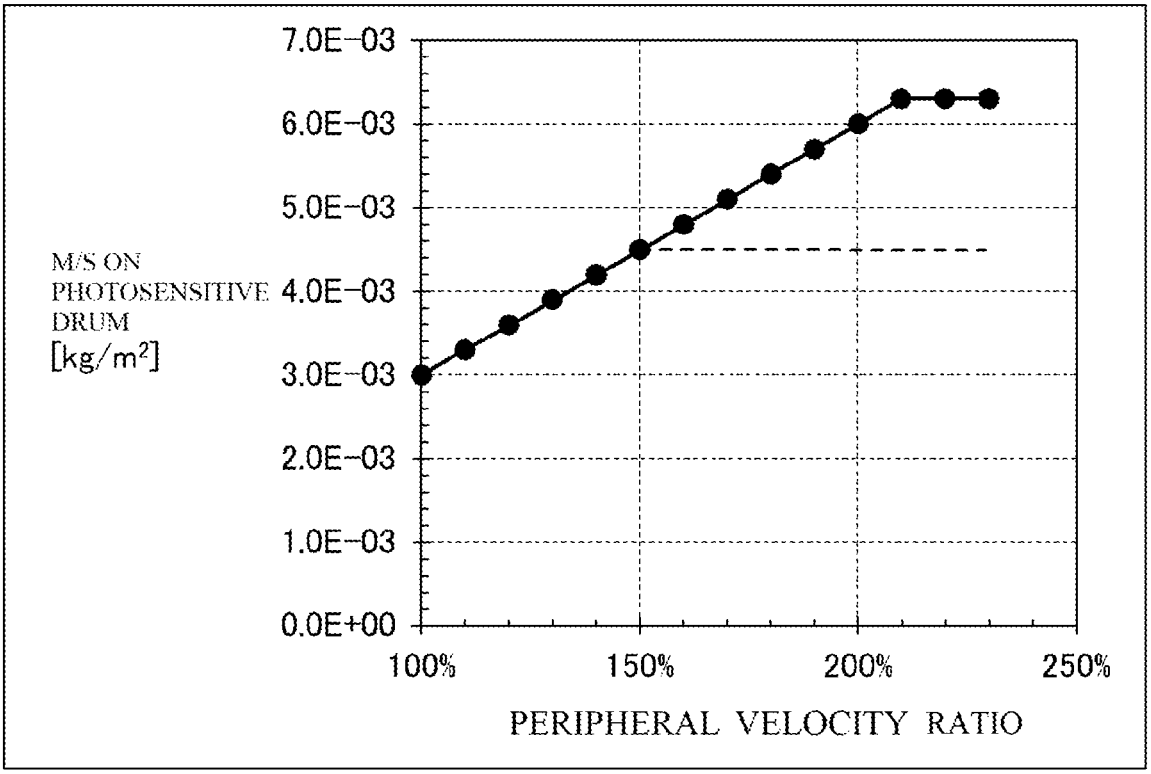
FIGS. 6A and 6B are explanatory diagrams of a peripheral velocity ratio and a toner state on a photosensitive drum according to Embodiment 1.
Figure 6B:
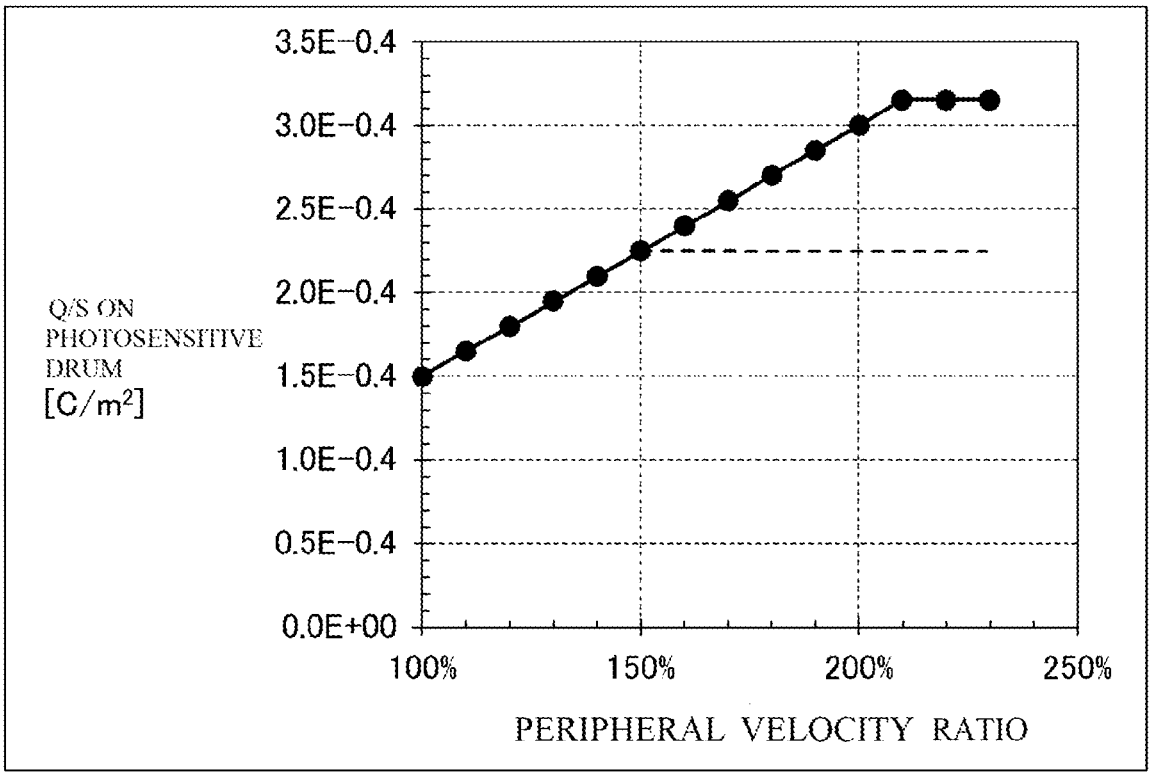

In FIG. 6A, a horizontal axis indicates a peripheral velocity ratio and a vertical axis indicates M/S on the photosensitive drum as an image bearing member. In FIG. 6B, a horizontal axis similarly indicates a peripheral velocity ratio and a vertical axis indicates Q/S of the toner developed on the photosensitive drum. As illustrated in FIGS. 6A and 6B, it is understood that the growth of M/S and Q/S with respect to the peripheral velocity ratio slows down near a peripheral velocity ratio of 210%. Moreover, a relation between the peripheral velocity ratio and M/S or Q/S when the developing contrast ΔV was set to 150 V is indicated by a broken line. This slowdown indicates that, when charged toner is supplied to the photosensitive drum, an electrical gradient formed by the developing contrast becomes gentle or disappears due to the charge of the toner and the supply of toner to the light-part potential portion of the photosensitive drum is saturated.

A developing contrast at a developing nip is formed by a light-part potential and a dark-part potential that form an electrostatic latent image formed on the photosensitive drum and a developing bias applied to the developing roller. With this developing contrast, toner on the developing roller moves to the photosensitive drum to form an electrostatic image. More specifically, the amount (a developable amount) of toner provided for developing is determined by the product of (i) an electrostatic capacitance (C) of a portion of the photosensitive drum and (ii) a developing contrast (ΔV), the portion is opposing to the developing roller and is supplied with the toner from the developing roller. The amount of toner provided for developing is corresponding to a total amount of the supplied electrification charge amount. That is, C×Δv indicates a total amount of the electrification charge amount of toner per unit area which can be moved (provided for developing) from the developing roller to the photosensitive drum at the developing nip which is an opposing portion at which the developing roller and the photosensitive drum oppose each other. Moreover, the total amount of electrification charge of the toner supplied to the photosensitive drum is determined by an electrification charge amount (Q/S) per unit area on the developing roller a peripheral velocity ratio (Δv) to the photosensitive drum and is represented by Q/S×Δv.

Figure 7:
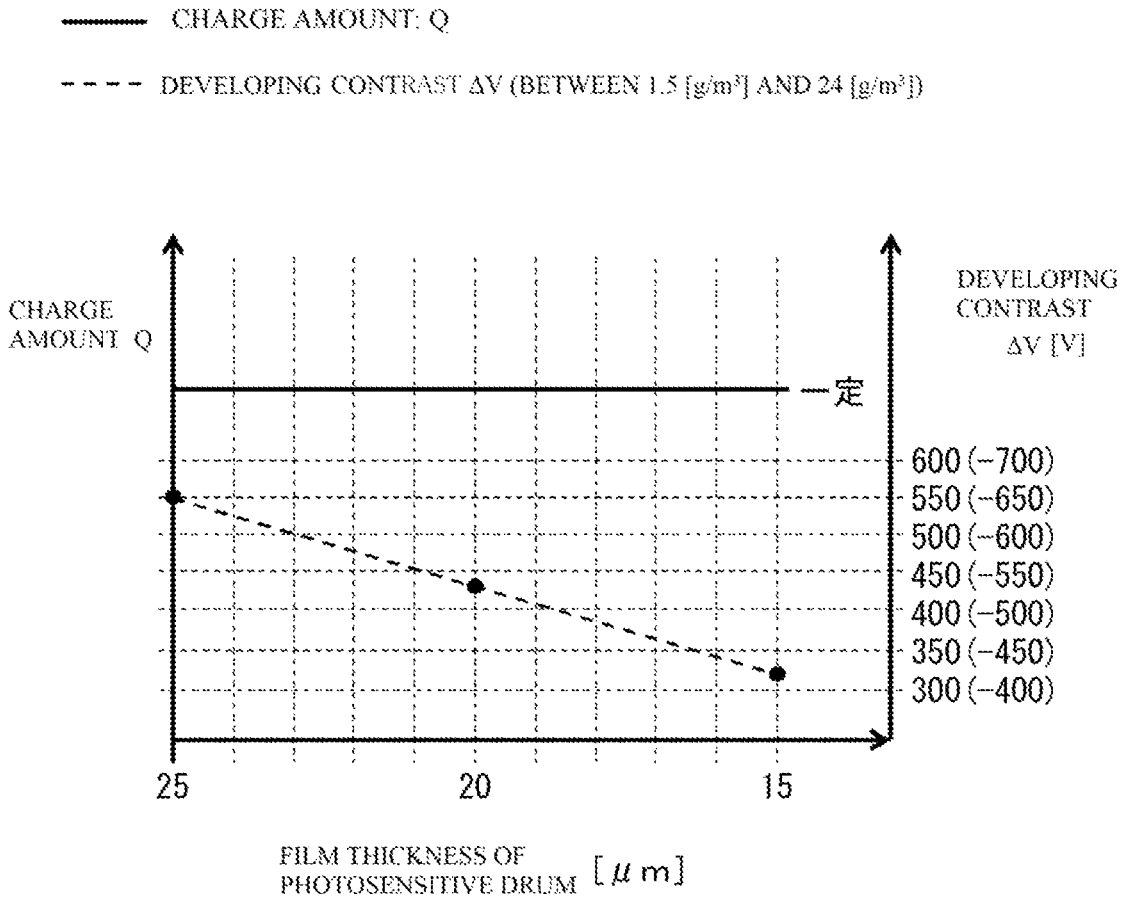
FIG. 7 is an explanatory diagram illustrating a relation between a film thickness and a charge amount of the photosensitive drum according to Embodiment 1.

A relation between the film thickness of the photosensitive drum 201 and the charge amount Q in the present embodiment is illustrated in FIG. 7. As illustrated in FIG. 7, the film thickness of the photosensitive drum 201 changes from 25 μm to 15 μm from the start to the end of the life of the photosensitive drum 201. In this case, in the present embodiment, the developing contrast is set so as to satisfy $\Delta V \leq (15/25)\Delta V_0$. Even when the film thickness of the photosensitive drum 201 decreases and the electrostatic capacitance C changes, the developing contrast ΔV is set such that the charge amount Q (=C×ΔV) is constant. Although it is not ideal that the developing contrast ΔV is set such that the charge amount Q is constant, there is no limitation thereto. It was found that a development ghost was suppressed similarly to the case of controlling the developing contrast ΔV as in FIG. 7 even if the remaining toner amount on the developing roller after developing had changed, if a predetermined amount of residual toner or more was present on the developing roller. Moreover, it was found that a development ghost was suppressed even when less than the predetermined amount of residual toner remained on the developing roller better than when a residual toner was not present.

From the above, a toner amount which can be provided for developing with respect to a developing contrast is represented by a relational example of |Q/S×Δv|=|C×ΔV|. That is, when a relation of |Q/S×Δv|≤|C×ΔV| is obtained when the peripheral velocity ratio Δv is changed, the total charge amount of the toner supplied from the developing roller becomes smaller than the charge amount received by the photosensitive drum. This case is the condition that the entire toner on the developing roller moves (is provided for developing) to the photosensitive drum. In contrast, in the case of |Q/S×Δv|>|C×ΔV|, a total charge amount of the toner supplied from the developing roller is larger than the charge amount received by the photosensitive drum. This case is the condition that after the toner on the developing roller moves to the photosensitive drum, a portion of the toner is used for developing, and the remaining toner remains on the developing roller without being used for developing. A peripheral velocity ratio Δv when the relation of |Q/S×Δv|≤|C×ΔV| is satisfied is an example of a first peripheral velocity ratio, and a peripheral velocity ratio Δv when the relation of |Q/S×Δv|>|C×ΔV| is satisfied is an example of a second peripheral velocity ratio. ΔV when |Q/S×Δv|≤|C×ΔV| is satisfied and ΔV when |Q/S×Δv|>|C×ΔV| is satisfied do not necessarily have the same magnitude. For example, a case of |ΔV1|<|ΔV2| when |Q/S×Δv|≤|C×ΔV1| and |Q/S×Δv|>|C×ΔV2| is atypical case.

Next, a condition that the electrostatic capacitance C of the photosensitive drum 201 changes will be described. The electrostatic capacitance C of the photosensitive drum 201 is determined by a permittivity (ε) and a film thickness (d) of the photosensitive drum 201 and a contact area (S) between the photosensitive drum 201 and the developing roller 302 and is represented by C=εS/d. Therefore, the permittivity of the photosensitive drum 201 changes when a moisture content that is moisture absorbed by the film of the photosensitive drum 201 changes according to the temperature and the humidity of an environment. As a result, the electrostatic capacitance C of the photosensitive drum 201 changes. As an example of variation in an ambient environment in the present embodiment, a low-temperature and low-humidity environment is a temperature of 15° C. and a humidity of 10%, and a high-temperature and high-humidity environment is a temperature of 30° C. and a humidity of 80%. Furthermore, as an example of an index of variation in an ambient environment in the present embodiment, 1.5 [g/m$^3$] which is an absolute moisture content at a temperature of 15° C. and a humidity of 10% is used as a first threshold, and 24 [g/m$^3$] which is an absolute moisture content at a temperature of 30° C. and a humidity of 80% is used as a second threshold.

The electrostatic capacitance C of the photosensitive drum 201 is represented by C=εS/d as described above. That is, since the film thickness d of the photosensitive drum 201 changes due to scraping associated with image forming, the electrostatic capacitance C of the photosensitive drum 201 also changes. In the present embodiment, 25 μm, 20 μm, and 15 μm are used as representative values of the film thickness of the photosensitive drum 201.

When the electrostatic capacitance C of the photosensitive drum 201 changes due to factors such as the temperature and the humidity of an ambient environment and the film thickness of the photosensitive drum 201, the developable amount of the toner developed by the developing contrast changes due to the relational expression of $|Q/S\times\Delta v|=|C\times\Delta V|$. In a high-density mode in which toner remains on the developing roller 302 after developing according to the present embodiment, the amount of residual toner after developing changes with change in the electrostatic capacitance C of the photosensitive drum 201. In this case, when the developing contrast is controlled so that the relation of $|Q/S\times\Delta v|>|C\times\Delta V|$ is satisfied, toner remains on the developing roller 302 after developing.

Next, a method of controlling the developing contrast so that the relation of $|Q/S\times\Delta v|>|C\times\Delta V|$ is satisfied according to a change in the electrostatic capacitance C of the photosensitive drum due to a change in the temperature and the humidity of an ambient environment and the film thickness of the photosensitive drum 201 will be described. In the present embodiment, the developing contrast is controlled using Table 1 below. The table in Table 1 is stored in the memory 220 of the image forming apparatus in advance in such a form that the table can be referred to by the CPU 215, and the table is referred to in the flowchart of FIG. 8 to be described later. Actually, the value set by the CPU 215 which is a setting unit is a developing bias, for example, and the values in the parenthesis in the table are developing biases when the dark-part potential is −500 V and the light-part potential after laser exposure is −100 V.

TABLE 1

| | Film thickness of photosensitive drum | | |
|---|---|---|---|
| Absolute moisture content | 25 [μm] | 20 [μm] | 15 [μm] |
| Smaller than 1.5 [g/m$^3$] | 450 V (−550 V) | 360 V (−460 V) | 270 V (−370 V) |
| At least 1.5 [g/m$^3$] and not more than 24 [g/m$^3$] | 550 V (−650 V) | 440 V (−540 V) | 330 V (−430 V) |
| Larger than 24 [g/m$^3$] | 600 V (−700 V) | 480 V (−580 V) | 360 V (−460 V) |

In Table 1, an environment in which an absolute moisture content that is moisture included in the ambient air is smaller than the first threshold of 1.5 [g/m$^3$] is defined as the low-temperature and low-humidity environment. Moreover, in Table 1, an environment in which an absolute moisture content that is moisture included in the ambient air is at least the first threshold of 1.5 [g/m$^3$] and not more than the second threshold of 24 [g/m$^3$] is defined as the normal-temperature and normal-humidity environment. Moreover, in Table 1, an environment in which an absolute moisture content included in the ambient air is larger than the second threshold of 24 [g/m$^3$] is defined as the high-temperature and high-humidity environment. Furthermore, in Table 1, a change in the film thickness with the life of the photosensitive drum 201 is defined as 25 μm, 20 μm, and 15 μm as a reprehensive example. In Table 1, the developing contrasts corresponding to the pairs of respective environments and the respective film thicknesses of the photosensitive drum 201 are defined. The definitions of the environments, the film thickness of the photosensitive drum, and the developing contrast illustrated in FIG. 1 are examples only.

When the film thickness at the start of the life of the photosensitive drum 201 is 25 μm and the film thickness at the end of the life of the photosensitive drum 201 is 15 μm, the electrostatic capacitance C at the end of the life of the photosensitive drum 201 is $C=(25/15)C_0$ with respect to an electrostatic capacitance $C_0$ at the start of the life of the photosensitive drum 201. In contrast, the developing contrast that satisfies the relation of $|Q/S\times\Delta v|>|C\times\Delta V|$ is $|\Delta V|\leq|(15/25)\Delta V_0|$ since it is sufficient that a relation of $|Q/S\times\Delta v|>|C_0\times\Delta V_0|\geq|(25/15)C_0\times\Delta V|$ is satisfied. Therefore, when the developing contrast $\Delta V_0$ at the start of the life of the photosensitive drum 201 is 550 V, the developing contrast ΔV at the end of the life of the photosensitive drum 201 can be determined to be 330 V or smaller. According to the present embodiment, the developing contrast is determined to be smaller as the remaining life of the photosensitive drum becomes shorter.

Figure 8:
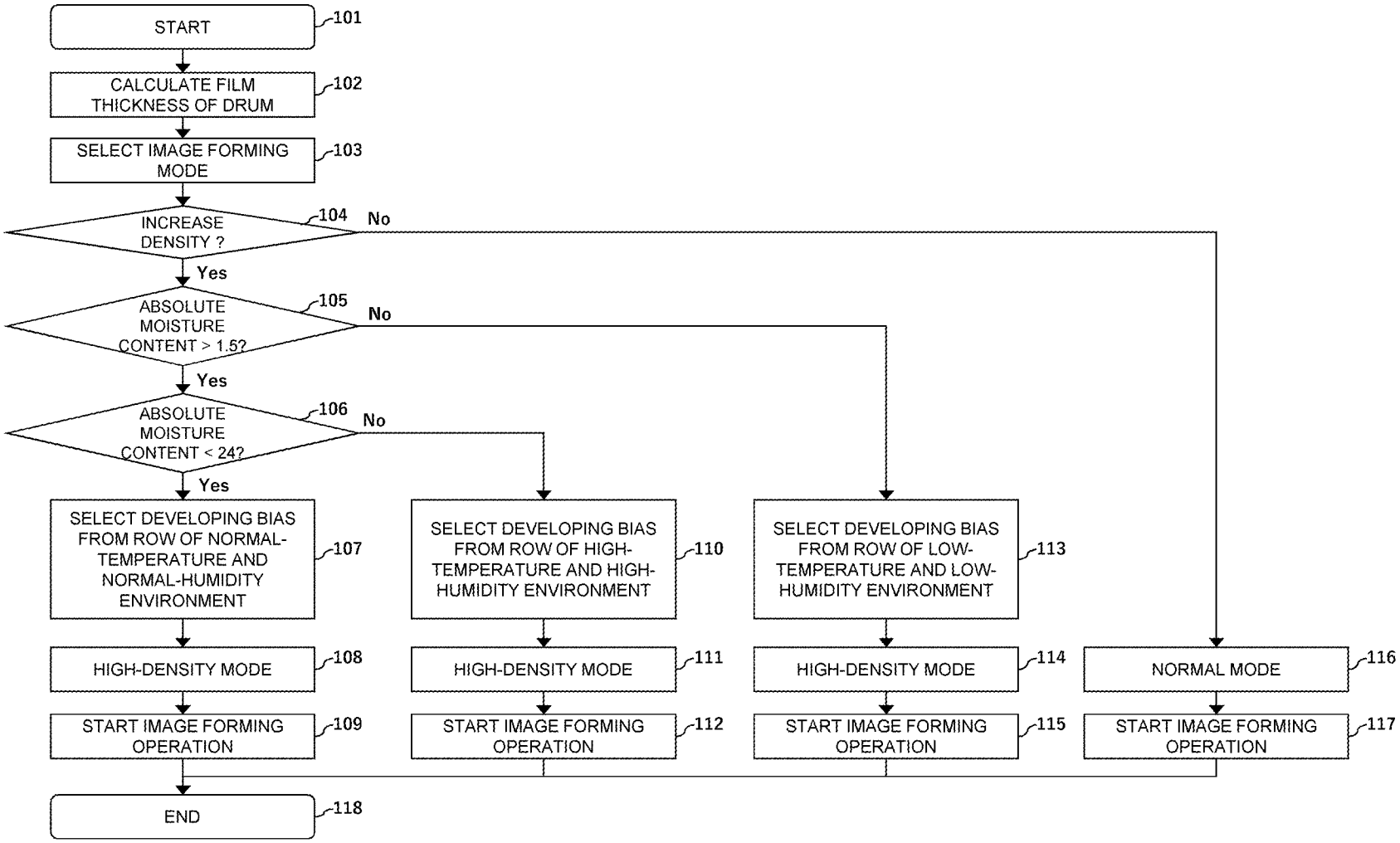
FIG. 8 is a flowchart of Embodiment 1.

Next, a process executed by the CPU 215 according to the present embodiment will be described in detail with reference to the flowchart illustrated in FIG. 8. In the following process, the CPU 215 functions as a determining unit that determines the developing contrast and controls the developing contrast according to the electrostatic capacitance of the photosensitive drum 201. In the following process, the CPU 215 uses the table of the developing contrast corresponding to the film thickness of the photosensitive drum 201 and the absolute moisture content of the ambient environment illustrated in Table 1 as the condition that the electrostatic capacitance C of the photosensitive drum 201 changes. The values of the developing contrasts may be determined in advance by tests, simulations, or the like. Moreover, the table may be stored in the memory 220 in advance.

When a process starts (step 101), the CPU 215 acquires information related to a driving amount of the developing unit 204 stored in the memory M1 of the developing unit 204 via the input/output I/F 230. Moreover, the CPU 215 acquires information related to a driving amount of the photosensitive member unit 301 stored in the memory M2 of the photosensitive member unit 301 via the input/output I/F 230. The CPU 215 calculates the film thickness of the photosensitive drum 201 on the basis of the acquired information (step 102). Specifically, the CPU 215 obtains a period in which a voltage is applied to the photosensitive drum 201 by the charging roller 202 and the developing roller 302 and the photosensitive drum 201 rotate in an abutting state. Moreover, the CPU 215 obtains a period in which a voltage is applied to the photosensitive drum 201 by the charging roller 202 and the developing roller 302 and the photosensitive drum 201 rotate in a separated state. Moreover, the CPU 215 obtains a period in which a voltage is not applied to the charging roller 202 and the developing roller 302 and the photosensitive drum 201 rotate in a separated state. Moreover, the CPU 215 multiplies the obtained periods by a coefficient and obtains an addition value of the multiplication results as the film thickness of the photosensitive drum 201. As a method of calculating the film thickness indicating the degree of accumulated use or the life of the photosensitive drum, a simplified calculation method which takes a period in which the developing roller 302 and the photosensitive drum 201 rotate in an abutting state only into consideration without taking the period of rotation in the separated state into consideration may be used.

The CPU 215 is an example of a second acquiring unit that acquires information related to a period in which an image bearing member (the photosensitive drum 201) rotates. Moreover, the information related to a period in which the image bearing member rotates may include a period in which the developing roller 302 and the photosensitive drum 201 rotate in an abutting state and a period in which the developing roller 302 and the photosensitive drum 201 rotate in a separated state. Here, the period in which the developing roller 302 and the photosensitive drum 201 rotate in an abutting state is an example of a first period. Moreover, the period in which the developing roller 302 and the photosensitive drum 201 rotate in a separated state is an example of a second period. Furthermore, the information related to a period in which the image bearing member rotates is an example of the information related to life of the image bearing member. Examples of the information related to the life of the image bearing member includes a rotation speed of the photosensitive drum 201 rotating in a state of abutting on the developing roller 302, the number of prints of the image forming apparatus 200, an operation period of the image forming apparatus 200, and a residual toner amount of the process cartridge 208. These pieces of information are acquired from respective control targets via the input/output I/F 230 by the CPU 215 and are stored in the memory 220 again via the input/output I/F 230.

After the process of step 102 is completed, a user selects an image forming mode (that is, the user issues an instruction for execution of an image forming operation to the image forming apparatus). The CPU 215 receives the selection of the image forming mode by the user (step 103). Actually, a selection instruction that designates an image forming mode is input to the CPU 215 via the input/output I/F 230.

The CPU 215 determines whether an image is to be formed in a high density on the basis of the selection of the received image forming mode (step 104). Determination herein means following a command that designates the input image forming mode. When the CPU 215 determines in step 104 that an image is to be formed in a high density (step 104; Yes), the flow proceeds to step 105. On the other hand, when the CPU 215 determines that an image is not to be formed in a high density (step 104: No), the flow proceeds to step 116.

In step 116, the CPU 215 controls the developing voltage application unit 412 and the charging voltage application unit 422 as a normal mode. The developing voltage application unit 412 and the charging voltage application unit 422 apply voltages to the charging roller 202 and the developing roller 302 according to the control of the CPU 215. The operations of the respective control targets such as the motor driving unit connected to the input/output I/F 230 are controlled by the CPU 215 and an image forming operation is performed (steps 116 and 117).

In step 105, the CPU 215 acquires information related to the moisture content detected by the sensor 219 via the input/output I/F 230. Moreover, the CPU 215 acquires information related to the threshold of the moisture content in the table of Table 1 stored in the memory 220. The CPU 215 determines whether the absolute moisture content of the ambient environment in the image forming apparatus 200 is larger than the first threshold of 1.5 [g/m$^3$] on the basis of the acquired information. In step 105, when the absolute moisture content of the ambient environment is larger than the first threshold of 1.5 [g/m$^3$] (step 105: Yes), the flow proceeds to step 106. On the other hand, when the absolute moisture content of the ambient environment is not larger than the first threshold of 1.5 [g/m$^3$] (step 105: No), the flow proceeds to step 113. In step 113, the CPU 215 selects the developing contrast corresponding to the film thickness of the photosensitive drum and the moisture content used in the determination in step 105 by referring to the table of Table 1. The CPU 215 increases the peripheral velocity ratio of the photosensitive drum to the developing roller as a high-density mode on the basis of the selected developing contrast and performs an image forming operation (steps 114 and 115). In the image forming operation of the high-density mode, the CPU 215 controls the application voltages of the developing voltage application unit 412 and the charging voltage application unit 422 and the operations of the other control targets.

In step 106, the CPU 215 determines whether the absolute moisture content of the ambient environment is smaller than the second threshold of 24 [g/m$^3$] on the basis of the information acquired in step 105. When the CPU 215 determines in step 106 that the absolute moisture content of the ambient environment is smaller than the second threshold of 24 [g/m$^3$] (step 106: Yes), the flow proceeds to step 107. On the other hand, when the CPU 215 determines that the absolute moisture content of the ambient environment is larger than the second threshold of 24 [g/m$^3$] (step 106: No), the flow proceeds to step 110.

In step 107, the CPU 215 selects a developing contrast corresponding to the film thickness of the photosensitive drum and the moisture content used in the determination in step 106 by referring to the table of Table 1 read from the memory 220. The CPU 215 increases the peripheral velocity ratio of the photosensitive drum to the developing roller as a high-density mode on the basis of the selected developing contrast and performs an image forming operation (steps 108 and 109).

In step 110, the CPU 215 selects a developing contrast corresponding to the film thickness of the photosensitive drum and the moisture content used in determination in step 106. The CPU 215 increases the peripheral velocity ratio of the photosensitive drum to the developing roller as a high-density mode on the basis of the selected developing contrast and performs an image forming operation (steps 111 and 112). In steps 111 and 112, in the image forming operation of the high-density mode, the CPU 215 controls the application voltages of the developing voltage application unit 412 and the charging voltage application unit 422 and the operations of the other control targets. When the image forming operation of steps 109, 112, 115, and 117 is completed, the CPU 215 ends the process of this flowchart (step 118).

As described above, in the present embodiment, in a high-density mode in which toner remains on the developing roller after developing, the film thickness of the photosensitive drum and the absolute moisture content of the ambient environment are used as parameters that change the electrostatic capacitance of the photosensitive drum. The developing contrast is determined to be larger as the moisture content becomes larger so that the relation of $|Q/S \times \Delta v| < |C \times \Delta V|$ is satisfied. In this way, even when the film thickness of the photosensitive drum decreases at the end of life, a change in the electrification charge amount of toner developable on the photosensitive drum can be suppressed. Furthermore, by maintaining the residual toner on the developing roller after developing and suppressing an increase in the difference between the electrification charge amounts of the post-no toner and the post-black toner, worsening of the development ghost can be suppressed.

In the present embodiment, although the film thickness of the photosensitive drum and the absolute moisture content of the ambient environment are used as the conditions that change the electrostatic capacitance C of the photosensitive drum, the values included in the conditions are not limited thereto. Moreover, in the present embodiment, as illustrated in Table 1, three film thicknesses are used as the conditions of the film thickness of the photosensitive drum and two thresholds are used as the conditions of the absolute moisture content. However, the numbers of film thicknesses and thresholds used in the conditions are not limited thereto. The conditions may be changed appropriately if a developing contrast corresponding to the electrostatic capacitance C of the photosensitive drum is determined so that the relation of $|Q/S \times \Delta v| > |C \times \Delta V|$ is satisfied.

Embodiment 2

Next, Embodiment 2 will be described. In the following description, a difference from Embodiment 1 will be described. The same components as those of Embodiment 1 will be denoted by the same reference numerals and the illustration and detailed description thereof will be omitted.

Figure 9:
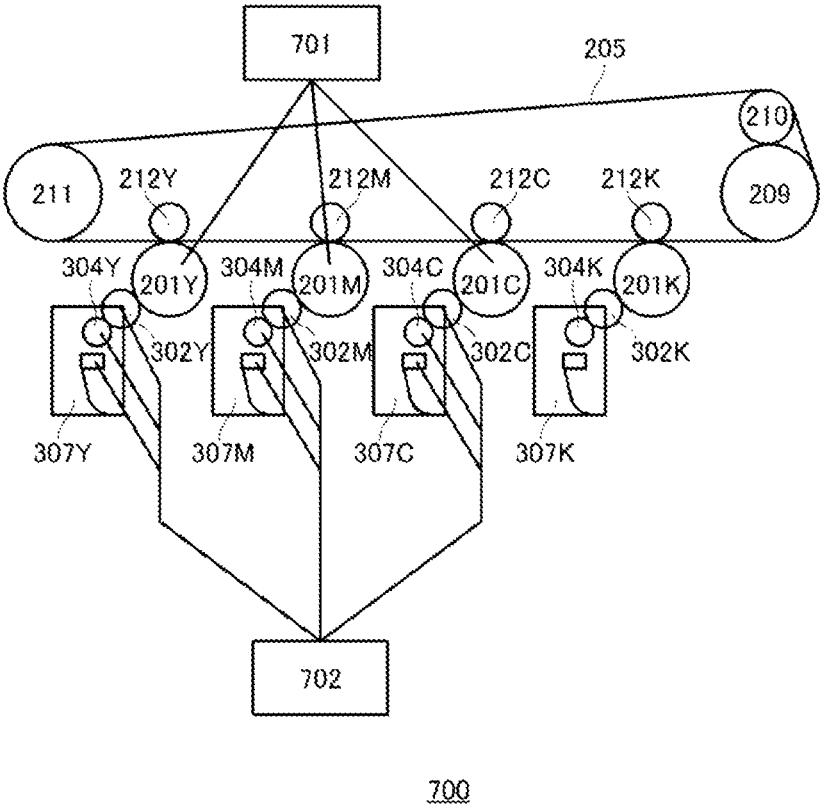
FIG. 9 is a schematic diagram illustrating a portion of an image forming apparatus according to Embodiment 2.

FIG. 9 is a schematic cross-sectional view illustrating an image forming station which is a portion of an image forming apparatus 700 according to the present embodiment. In Embodiment 1, the developing rollers of the first, second, third, and fourth image forming stations SY, SM, SC, and SK for forming the images of the respective colors of yellow (Y), magenta (M), cyan (C), and black (K) are driven by independent motors. In the present embodiment, the developing rollers 302Y, 302M, and 302C, the toner supply rollers 304Y, 304M, and 304C, and the stirring members 307Y, 307M, and 307C of the image forming stations of the colors of yellow (Y), magenta (M), and cyan (C) are driven by a common motor. In this way, it is possible to commonize the driving control units of the image forming stations of the target colors in which a high density and an extended gamut are required to reduce the size and the cost of the main body.

Specifically, a motor driving unit 701 drives the photosensitive drums 201Y, 201M, and 201C of the colors of yellow (Y), magenta (M), and cyan (C). Moreover, a motor driving unit 702 drives the developing rollers 302Y, 302M, 302C, the toner supply rollers 304Y, 304M, and 304C, and the stirring members 307Y, 307M, and 307C of the colors of yellow (Y), magenta (M), and cyan (C). The motor driving units 701 and 702 are connected to the CPU 215, and driving of the motor driving units 701 and 702 is controlled by the CPU 215.

In the present embodiment, since the image forming apparatus 700 has the above-described configuration, the control of the motor driving units of the colors of yellow (Y), magenta (M), and cyan (C) in which a high density and an extended gamut are required is commonized. That is, when an image forming apparatus has a plurality of pairs of image bearing members and developer bearing members, a driving unit can drive the respective developer bearing members included in the plurality of pairs according to common control. In this way, it is possible to reduce the number of motor driving units disposed in the image forming apparatus 700 and to reduce the size of the image forming apparatus 700. Furthermore, it is possible to obtain a cost-down effect by decreasing the number of motor driving units.

OTHER EMBODIMENTS

The above-described embodiments are exemplary embodiments described to illustrate the present invention, and the present invention can be implemented by appropriately changing or combining the embodiments without departing from the scope of the invention. For example, in the above-described embodiments, although the moisture content of the ambient environment in the image forming apparatus is detected by the sensor 219, the temperature and the humidity of the ambient environment in the image forming apparatus may be detected by the sensor 219. In this case, a temperature of 15° C. and a humidity of 10% may be used as a threshold instead of the first threshold of 1.5 [g/m$^3$] of the absolute moisture content in Table 1. Moreover, a temperature of 30° C. and a humidity of 80% may be used as a threshold instead of the second threshold of 24 [g/m$^3$] of the absolute moisture content. Moreover, the image forming apparatus determines the developing contrast to be larger as the temperature and the humidity become higher. In this manner, the control of the developing contrast according to the electrostatic capacitance can be realized by the above-described process even when the temperature and the humidity in the apparatus are detected. Moreover, in the above-described embodiments, instead of changing the setting of the developing bias, the developing contrast may be controlled by changing the laser intensity of a laser that performs laser exposure and changing the setting of a charging bias. Alternatively, the developing contrast may be controlled by changing the setting the charging bias and the laser intensity and changing the setting of the developing bias in combination.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-172925, filed on Sep. 14, 2018, and, Japanese Patent Application No. 2019-143084, filed on Aug. 2, 2019, which are hereby incorporated by reference herein in their entirety.

What is claimed is:

1. An image forming apparatus comprising:

an image bearing member;

a developer bearing member configured to develop an electrostatic image formed on the image bearing member using a developer;

a driving unit configured to drive to rotate the image bearing member and the developer bearing member;

a latent image forming unit configured to form an electrostatic image on the image bearing member by forming a light-part potential and a dark-part potential in the image bearing member; and an application unit configured to apply a developing voltage to the developer bearing member, a control unit configured to control a developing contrast between the developing voltage and the light-part potential of the image bearing member, wherein the image forming apparatus is configured to transfer a developer image borne on the image bearing member to a recording material to form an image on the recording material, wherein the driving unit is capable of driving the image bearing member and the developer bearing member in a first peripheral velocity ratio which is a ratio of a peripheral velocity of the developer bearing member to a peripheral velocity of the image bearing member and in a second peripheral velocity ratio that is larger than the first peripheral velocity ratio, wherein an electrostatic capacitance of a portion of the image bearing member is designated as C, the portion is supplied with the developer borne on the developer bearing member, a developing contrast is designated as $\Delta V$, the developing contrast being a potential difference between the light-part potential and the developing voltage, a charge amount per unit area of the developer borne on the developer bearing member is designated as Q/S, and the peripheral velocity ratio is designated as $\Delta v$, the peripheral velocity ratio being the ratio of the peripheral velocity of the developer bearing member to the peripheral velocity of the image bearing member, the first peripheral velocity ratio is set so that a relation of $|Q/S \times \Delta v| \leq |C \times \Delta V|$ is satisfied, and the second peripheral velocity ratio is set so that a relation of $|Q/S \times \Delta v| > |C \times \Delta V|$ is satisfied, wherein the image forming apparatus further comprises a first detecting unit configured to detect a moisture content of an ambient environment in the image forming apparatus, and wherein the control unit controls the developing contrast to be larger as the detected moisture content becomes larger when the driving unit drives the image bearing member and the developer bearing member in the second peripheral velocity ratio.

2. The image forming apparatus according to claim 1, further comprising a second detecting unit configured to detect a temperature and a humidity of the ambient environment in the image forming apparatus, and wherein the control unit controls the developing contrast to be larger as the detected temperature and humidity become higher when the driving unit drives the image bearing member and the developer bearing member in the second peripheral velocity ratio.

3. The image forming apparatus according to claim 1, further comprising an acquiring unit configured to acquire information related to life of the image bearing member, and wherein the control unit controls the developing contrast to be smaller as the life of the image bearing member indicated by the information acquired by the acquiring unit becomes shorter when the driving unit drives the image bearing member and the developer bearing member in the second peripheral velocity ratio.

4. The image forming apparatus according to claim 3, wherein the information related to the life of the image bearing member includes information related to a period in which the image bearing member rotates, and wherein the control unit controls to calculate a film thickness of the image bearing member on the basis of the information related to a period in which the image bearing member rotates acquired by the acquiring unit and controls the developing contrast to be smaller as the calculated film thickness becomes smaller when the driving unit drives the image bearing member and the developer bearing member in the second peripheral velocity ratio.

5. The image forming apparatus according to claim 4, wherein the information related to the period in which the image bearing member rotates includes information related to a first period in which the image bearing member rotates in a state of abutting on the developer bearing member and information related to a second period in which the image bearing member rotates in a state of being separated from the developer bearing member, and wherein the control unit controls to calculate a film thickness of the image bearing member on the basis of the first period and the second period.

6. An image forming apparatus comprising:

an image bearing member;

a developer bearing member configured to develop an electrostatic image formed on the image bearing member using a developer;

a driving unit configured to drive to rotate the image bearing member and the developer bearing member;

a latent image forming unit configured to form an electrostatic image on the image bearing member by forming a light-part potential and a dark-part potential in the image bearing member; and an application unit configured to apply a developing voltage to the developer bearing member, a control unit configured to control a developing contrast between the developing voltage and the light-part potential of the image bearing member, wherein the image forming apparatus is configured to transfer a developer image borne on the image bearing member to a recording material to form an image on the recording material, wherein the driving unit is capable of driving the image bearing member and the developer bearing member in a first peripheral velocity ratio which is a ratio of a peripheral velocity of the developer bearing member to a peripheral velocity of the image bearing member and in a second peripheral velocity ratio that is larger than the first peripheral velocity ratio, wherein an electrostatic capacitance of a portion of the image bearing member is designated as C, the portion is supplied with the developer borne on the developer bearing member, a developing contrast is designated as $\Delta V$, the developing contrast being a potential difference between the light-part potential and the developing voltage, a charge amount per unit area of the developer borne on the developer bearing member is designated as Q/S, and the peripheral velocity ratio is designated as $\Delta v$, the peripheral velocity ratio being the ratio of the peripheral velocity of the developer bearing member to the peripheral velocity of the image bearing member, the first peripheral velocity ratio is set so that a relation of $|Q/S \times \Delta v| \leq |C \times \Delta V|$ is satisfied, and the second peripheral velocity ratio is set so that a relation of $|Q/S \times \Delta v| > |C \times \Delta V|$ is satisfied, wherein the image forming apparatus further comprises a first detecting unit configured to detect a moisture content of an ambient environment in the image forming apparatus, and wherein, when the driving unit drives the image bearing member and the developer bearing member in the second peripheral velocity ratio, the control unit controls so that a second developing contrast set when a second moisture amount larger than a first moisture amount is detected is larger than a first developing contrast set when the first moisture amount is detected.

7. The image forming apparatus according to claim 6, further comprising a second detecting unit configured to detect a temperature and a humidity of the ambient environment in the image forming apparatus, and wherein, when the driving unit drives the image bearing member and the developer bearing member in the second peripheral velocity ratio, the control unit controls so that a second developing contrast set when a second temperature higher than a first temperature and a second humidity higher than a first humidity is detected is larger than a first developing contrast set when the first temperature and the first humidity are detected.

8. The image forming apparatus according to claim 6, further comprising an acquiring unit configured to acquire information related to life of the image bearing member, and wherein the control unit controls the developing contrast to be smaller as the life of the image bearing member indicated by the information acquired by the acquiring unit becomes shorter when the driving unit drives the image bearing member and the developer bearing member in the second peripheral velocity ratio.

9. The image forming apparatus according to claim 8, wherein the information related to the life of the image bearing member includes information related to a period in which the image bearing member rotates, and wherein the control unit controls to calculate a film thickness of the image bearing member on the basis of the information related to a period in which the image bearing member rotates acquired by the acquiring unit and controls the developing contrast to be smaller as the calculated film thickness becomes smaller when the driving unit drives the image bearing member and the developer bearing member in the second peripheral velocity ratio.

10. The image forming apparatus according to claim 9, wherein the information related to the period in which the image bearing member rotates includes information related to a first period in which the image bearing member rotates in a state of abutting on the developer bearing member and information related to a second period in which the image bearing member rotates in a state of being separated from the developer bearing member, and wherein the control unit controls to calculate a film thickness of the image bearing member on the basis of the first period and the second period.

* * * * *